United States Patent [19]

Hirsch et al.

[11] 4,345,012

[45] Aug. 17, 1982

[54] ELECTROPHOTOGRAPHIC METHOD OF GENERATING ELECTROSTATIC IMAGES ON TWO SIDES OF AN INSULATING FOIL

[75] Inventors: Hans J. Hirsch, Selfkant-Tüddern; Horst Dannert, Aachen-Walheim, both of Fed. Rep. of Germany

[73] Assignee: U.S. Philips Corporation, New York, N.Y.

[21] Appl. No.: 124,406

[22] Filed: Feb. 25, 1980

[30] Foreign Application Priority Data

Mar. 5, 1979 [DE] Fed. Rep. of Germany ..... 2908603

[51] Int. Cl.[3] ..... G03G 13/044

[52] U.S. Cl. ..... 430/48; 430/54; 361/229; 361/233

[58] Field of Search ..... 430/902, 31, 48, 54; 250/326; 361/229, 235, 233; 427/14.1

[56] References Cited

U.S. PATENT DOCUMENTS

| | | | |
|---|---|---|---|
| 3,378,645 | 4/1968 | Heller | 427/14.1 |
| 3,470,417 | 9/1969 | Gibbons | 250/326 |
| 3,594,159 | 7/1971 | Kaufman | 430/31 |
| 3,615,383 | 10/1971 | Inoue | 430/54 |
| 3,651,323 | 10/1972 | Tanaka et al. | 250/326 |
| 3,945,822 | 3/1976 | Verhille | 430/54 |

*Primary Examiner*—Richard L. Schilling
*Assistant Examiner*—John L. Goodrow
*Attorney, Agent, or Firm*—Marc D. Schechter

[57] ABSTRACT

Electrostatic charge images of identical shape but opposite sign are generated on both sides of a transparent, highly insulating foil. Subsequently, pigment is deposited on both sides of the foil by means of oppositely charged developers. The optical density of an electrophotographic image on a transparent insulating foil is increased, as compared to densities achieved in the past, for a given surface charge density by establishing a charge exchange between one side of the foil and an electrode. On the other side of the foil a charge image is generated and the foil. The electrode are separated from each other prior to development.

5 Claims, 9 Drawing Figures

ELECTROPHOTOGRAPHIC METHOD OF GENERATING ELECTROSTATIC IMAGES ON TWO SIDES OF AN INSULATING FOIL

BACKGROUND OF THE INVENTION

The invention relates to an electrophotographic method where electrostatic charge images of identical shape but opposite sign are generated on both sides of a transparent, highly insulating foil, pigment being deposited on both sides of the foil by means of oppositely charged developers.

Electrophotography utilizes the local variation of the conductivity of a flat photosemiconductor in reaction to light for generating images (Ullmans Encyklopädie der technischen Chemie, 3rd edition, volume 14 (Munich-Berlin 1963) page 678). Electroradiography is a special kind of electrophotography. While electrophotography utilizes light rays for the recording, electroradiography utlizes X-rays or other directly ionizing rays. (German Offenlegungsschrift No. 26 41 067.) Ionography is another special kind of electrophotography for recording X-ray images. In ionography, a latent image of the radiogram is formed as a distribution of the electric charge on an insulating surface rather than another selenium or photoconductor. The latent image is generated by collecting ions on the surface of an insulating foil which is suspended in front of an electrode of an ionization chamber. These ions are formed by radiation in a layer of a suitable gas which fills the space adjoining the foil. The latent image generated by the electric charge pattern can be made visible (developed) in various ways which are customarily used in electrophotography, (German Offenlegungsschrift No. 24 31 036 which corresponds to U.S. Pat. No. 3,963,924.)

The ionographic method described in U.S. Pat. No. 3,963,924 German Offenlegungsschrift No. 24 31 036 utilizes ionizing radiation which passes through an object to be imaged and which subsequently passes into an ionization chamber. The ionization chamber contains a layer of a gas, at least some atoms of which have a high absorption coefficient for X-rays. The gas layer is bounded by a pair of electrodes which sustain an electric field in the chamber. The ions produced in the gas layer are collected on the surface of a transparent insulating foil. In a modified version of this method, the foil is centrally arranged in the ionization chamber so that positive ions are collected on one side and an equal charge of negative ions is collected on the other side, the ions of opposite charge keeping each other in position as a result of their force of attraction, the net load on the foil being almost zero. It is important that the foil is held exactly in such a position that the opposite charges obtained on both sides of the foil are equal. The correct position is usually situated in the vicinity of the geometrical center of the gas layer. Both surfaces of a foil thus charged can be developed by means of some known method, for example, development by powder or liquid or by introduced or deposited substances with optically active properties.

Direct absorption of X-rays in a gas in the vicinity of the recording layer produces pairs of ions which are separated by an applied electric field, so that ions of the same charge polarity are collected on the recording layer. In the ionization chamber shown in FIG. 8 of the German Offenlegungsschrift 24 31 036, a number of charge pairs are formed by irradiation. After the irradiation is completed, negative charges are present on one side of the foil and positive charges are present on the other side of the foil. The number of such charge pairs amounts to half the number of charge pairs originally formed, because the positive partners of the charge pairs formed on one side of the foil proceed to the cathode, while the negative partners of the charge pairs formed on the other side of the foil proceed to the anode and are lost as far as the recording process is concerned. For the sake of comparison it is assumed that the method known from German Offenlegungsschrift No. 24 31 036 produces an optical density amounting to 1 on a single foil. This assumption wil be described further below.

SUMMARY OF THE INVENTION

An object of the invention is to increase the optical density of electrophotographic images on a single, transparent, highly insulating foil at a given surface charge density.

To this end, the method according to the invention is characterized in that there is a charge exchange between one side of the foil and an electrode. At the same time a charge image is generated on the other side of the foil. The foil and the electrode are then separated from each other prior to development.

For making the charge image, the method according to the invention can utilize all known methods and devices, for example, the methods and devices described above. When use is made of a transparent, highly insulating foil, a charge exchange occurs between one side of the foil and an electrode, and a charge image is formed on the other side of the foil. For example, when real negative electric charges are present on the free foil surface, the associated charges of opposite polarity, i.e. real positive charges, are formed on the other side of the foil, that is to say on the electrode side.

Preferably, but not necessarily, the electrode is connected to the foil to be charged, i.e. it is in intimate contact therewith. The electrode can also be formed by a corona discharge.

As a result of the separation of the foil and the electrode from each other prior to development, according to the invention, the charges which are present on the electrode side of the foil are also used for making the charge image visible. When the charges on both sides of the foil are developed by depositing pigment on both sides of the foil by means of oppositely charged developers, an advantage is achieved over known methods in that an image with an optical density 2 is formed on the foil.

BRIEF DESCRIPTION OF THE DRAWING

The invention will be described in detail hereinafter with reference to the accompanying diagrammatic drawing.

DESCRIPTION OF THE PREFERRED EMBODIMENTS

Figure 1:
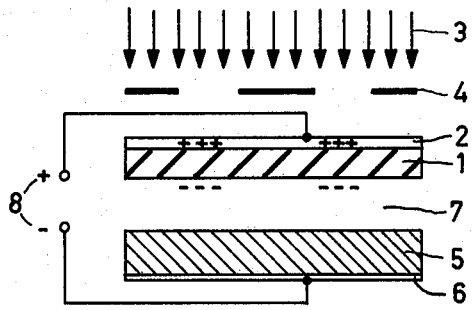
FIGS. 1, 2 and 3 show devices for forming charge images.

In the device shown in FIG. 1 a charge image which corresponds to an object 4 is generated, by means of radiation 3, on a transparent, highly insulating foil 1. The back side of foil 1 is provided with an electrically conductive layer, electrode 2. The radiation generates charge carriers in a photoconductive layer 5. The photoconductive layer 5 is connected on one side to an electrode. The other side of layer 5 contacts, via a gas gap 7, the foil 1. The electrodes 2 and 6 are interconnected via a voltage source 8. Electrode 2 comprises, for example, a liquid layer, consisting of glycerine with an ionogenic addition, or a conductive solid substance.

As denoted by plus and minus signs in FIG. 1, real negative electric charges are present on the free surface of the foil. The associated charges of opposite polarity are present on the opposite side of the foil with electrode 2.

After generating the charge image, the electrode 2 on the back side of the foil 1 is removed. When glycerine with an ionogenic addition is used, the electrode is removed by rinsing first with water and subsequently with isopropanol. Water and isopropanol residues are removed by drying. As has already been stated, other electrode materials can alternatively be used. When the electrode is removed, however, care must be taken so that no additional charges are generated by friction. Cleaning must be performed without mechanical loading. The unavoidable transverse conductivity, i.e. electrical conductivity in the direction of the foil surface, is of no importance, because all image charges are rigidly retained by the charges on the dry side of the foil. However, simultaneous contacting of an electrically conductive medium by both foil sides must always be prevented. After removal of the electrode, both foil sides carry real electric charges.

Figure 2:
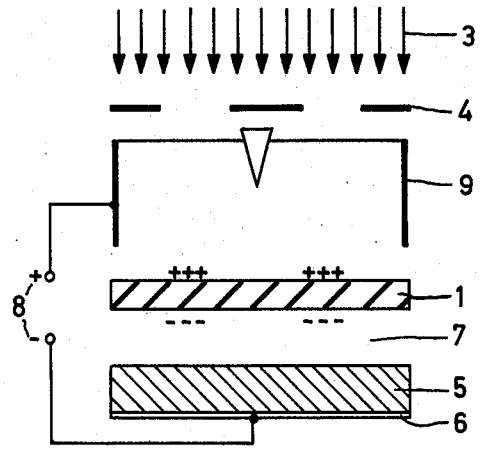

FIG. 2 corresponds to FIG. 1, however in FIG. 2 the voltage source is coupled to the foil via a corona gas discharge 9. This device directly produces a charge image which consists of real charges on both sides of the foil.

Figure 3:
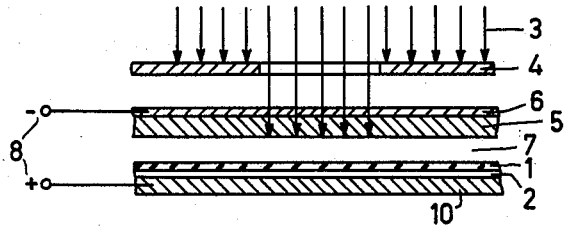

In the device shown in FIG. 1, the electrode 2 must be radiation-transparent. FIG. 3 shows a device where this need not be the case. The foil 1 is situated on the side of the device which need not be radiation transparent. The foil 1 is arranged on a metal carrier plate 10. Between the carrier plate and the foil there is provided a liquid intermediate layer 2 which serves to form a homogeneous conductive connection between the foil and the carrier plate which can be readily interrupted. After the formation of the charge image in the device shown in FIG. 3, the foil 1 must be separated from the carrier plate 10 and the intermediate layer 2 must be removed therefrom.

After generating the charge image in the devices shown in the FIGS. 1, 2 or 3 and after separating the foil from the electrode, both surfaces of the highly insulating transparent foil carry the same number of real charges of opposite sign which represent an image.

Figure 4:
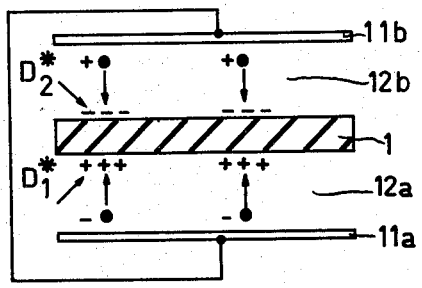
FIG. 4 shows a device for developing charge images.

A device for developing these charge images is shown in FIG. 4. Opposite the charge images there are arranged developing electrodes 11*a* and 11*b*. The developing chambers 12*a* and 12*b* contain developer suspenions with oppositely charged pigment particles. During development, pigment is deposited on both sides of the foil 1. The symbols $D_1$* and $D_2$* will be described below.

Figure 5:
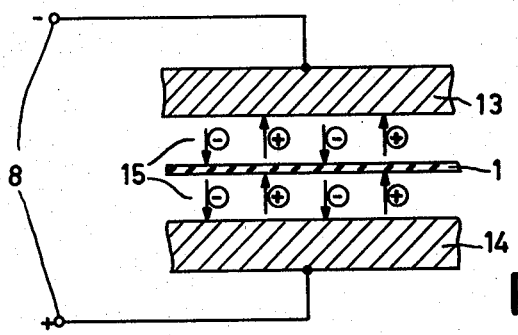
FIG. 5 shows a known device for forming charge images.

In order to clarify the invention, the already described state of the art is also shown in the drawing. As shown in German Offenlegungsschrift No. 24 31 036 (FIG. 8), FIG. 5 herein shows an ionization chamber 15 which is bounded by electrodes 13 and 14 and in which an ionizable gas is present. A foil 1 is arranged in the center of the chamber. FIG. 5 also shows four charge carrier pairs which have been formed by radiation. For each charge pair, one negative or positive partner of the pair proceeds to an electrode and is lost to the process. In the device shown in FIG. 5, only the two negative charges on the top side of the foil and only the two positive charges on the back side of the foil can be developed. As has already been stated, this results in a density amounting to 1.

Figure 6:
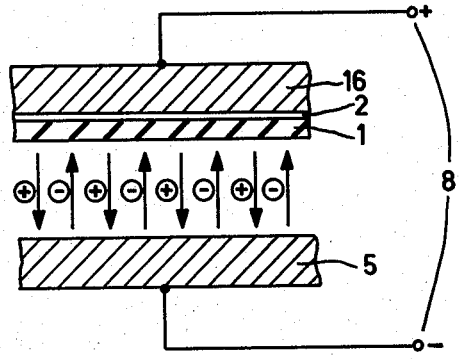
FIG. 6 is a simplified representation of the device shown in FIG. 1.

For better comparison with FIG. 5, FIG. 6 shows a simplified modication of the device shown in FIG. 1. In FIG. 6, the reference numeral 2 again denotes a liquid of low conductivity, for example, alcohol or glycerine with ionogenic addition. The reference numeral 16 denotes an X-ray transparent, conductive carrier plate, for example of graphite or beryllium. As in FIG. 5, four charge carrier pairs are formed. At the end of the exposure, four negative charges are present on the foil 1. The four positive partners disappear in the photoconductive layer 5. If the image foil 1 in this condition is brought into contact with a developer in a device as shown in FIG. 7, without the foil being detached from the electrode, a density amounting to 1 is obtained again.

Figure 7:
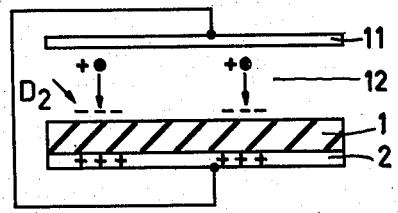
FIG. 7 shows a known device for developing charge images.

FIG. 7 shows a customary device for liquid development of a charge image. Therein, a developing electrode 11 is arranged opposite the charge image. The developing electrode and the back electrode 2 of the foil 1 are brought into electrically conductive contact. The space 12 between the developing electrode and the foil surface is filled with a liquid developer. The symbol $D_2$ will be described below.

For example, if the pigment particles are positively charged while the foil surface is negatively charged, as shown in FIG. 7, pigment is deposited on the foil surface at the areas of negative charge. At the same time, however, the charge carrier distribution in the back electrode 2 of the foil which consists of a current to the developing electrode 11 also changes and causes equalization of the charge carrier distribution in the rear electrode 2.

It can be established that the known method utilizes only the transport of the charged pigment particles to the foil surface for making the charge image visible, while all other charge carrier currents are not used.

Figure 8:
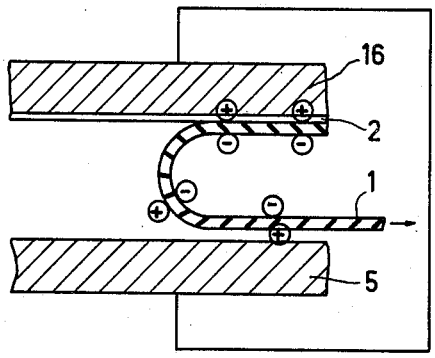
FIG. 8 shows the separation of electrode and foil.

However, if the charged foil 1 is detached from the electrode 2 as denoted by an arrow in FIG. 8, the associated four positive charges adhere, due to the electrostatic force of attraction. The positive charges are located exactly opposite the negative charges on the rear of the image foil. The foil then accommodates four negative and four positive charges. These can be developed to produce a density amounting to 2.

In order to demonstrate that a density amounting to 2 is obtained by means of the method according to the invention, three experiments (a, b and c) were carried out. These experiments will be successively described.

As has already been described, in the device shown in FIG. 4 pigment is deposited on both sides of the foil 1 during development. This development corresponds to the experiment c yet to be described. The optical density D* then obtained has an additive composition $D^*=D^*_1+D^*_2$(see the symbols in FIG. 4).

As will be separately demonstrated hereinafter, the experiments reveal that $D^*_1$ and $D^*_2$ (experiment c) are identical to the optical densities $D_1$ and $D_2$ obtained when the same charge images on the two foil surfaces are separately developed by means of a device as shown in FIG. 7 (experiments a and b).

Instead of using a device as shown in FIG. 7, for example, for the negative surface charges (experiment a) the device shown in FIG. 4 was modified as follows in order to obtain the device shown in FIG. 7.

The foil surface carrying the positive charges is provided with an electrode which itself is conductively connected to the developing electrode 11*b*. The pigment particles deposited on the free surface produce the optical density $D_2$, i.e. the same value as the value to be assigned to the negative charges during development in accordance with FIG. 4 ($D^*_2$). After deposition (according to FIG. 7), the capacitor device has been completely or substantially completely discharged. This means that no further charges can be deposited by a subsequent method, unless a new charge pattern is impressed.

The deposition shown in FIG. 4, however, results in a higher optical density. For example, if the two developers used are equally sensitive, a factor of two times the optical density is achieved.

For all three experiments a polyethylene terephthalate foil is charged to a surface potential of -400 Volts by means of the device of FIG. 1, which means that the initial surface charge density is always the same. Two different developers are used, one with positively charged pigment and the other with negatively charged pigment, contained in the upper part and the lower part, respectively, of the developing chamber shown in FIG. 4.

Experiment (a) The upper part of the developing chamber according to FIG. 4 is used in this experiment. The lower side of the foil, carrying the positive charges, is provided with an electrode. A conductive connection is made from this electrode to the developing electrode 11*b*. After development with the positively charged developer, the optical density is measured: $D_2=0.82$.

Experiment (b) The lower part of the developing chamber according to FIG. 4 is used and the procedure is otherwise according to experiment (a). The optical density is then measured: $D_1=0.65$.

Experiment (c) Both developing chambers according to FIG. 4 are used. The optical density is measured: $D=1.42$.

Taking into account the measuring accuracy , D* is additively composed of $D_1$ and $D_2$. When the pigment of the negatively charged developer is removed from one side of the foil, the subsequent measurement of the optical density produces $$D^*_2=0.78.$$

The same is applicable to the developer with positively charged pigment removed.

$D^*_1=0.65$ is obtained.

The following is applicable within the accuracy of the above measurements.

$$D^*_1=D_1,\ D^*_2=D_2.$$

Figure 9:
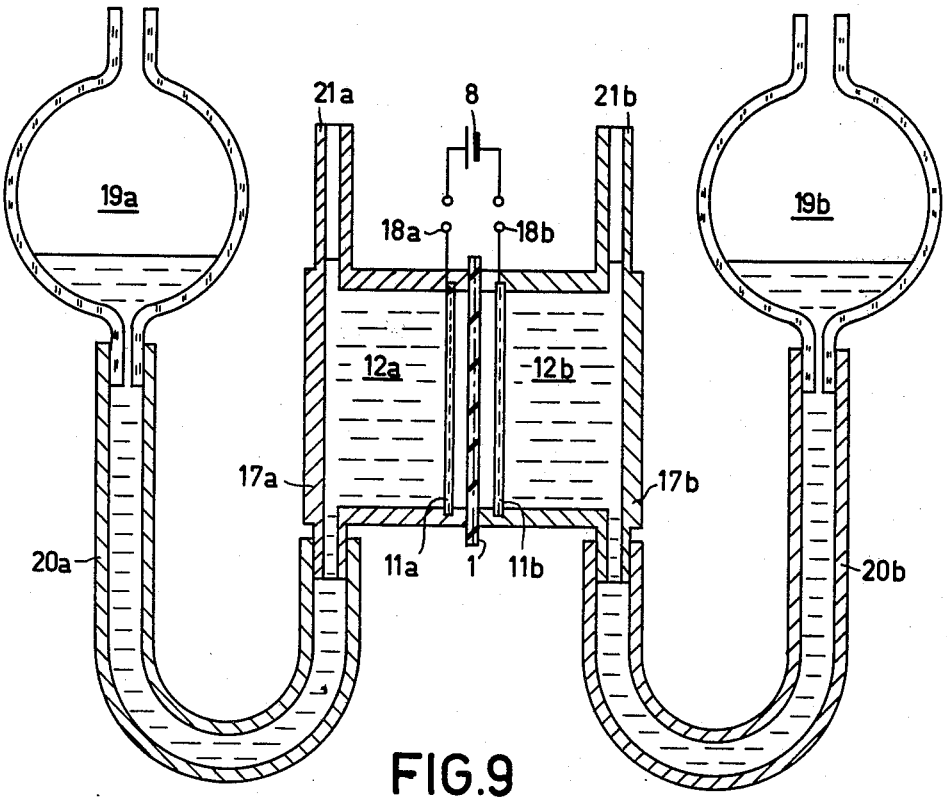
FIG. 9 shows a developing device which enables development of both sides of the foil.

FIG. 9 shows a developing device which comprises two developing tanks 17*a* and 17*b*, for example of polymethacrylate, in which two developing electrodes 11*a* and 11*b*, for example gauze with a mesh width of 0.5 mm, are arranged so that their distances from the surfaces of the charged foil 1 amount to from 0.1 to 5 mm, preferably from 0.5 to 1 mm. They are conductively connected to contacts 18*a* and 18*b* which are accessable from the outside. As desired, these contacts may be short-circuited during development or may be connected to a voltage source 8 in order to increase the image contrast, that is in order to compensate for any background charges. The siphon vessels 19*a* and 19*b* contain developers of opposite polarity. Via tubes 20*a* and 20*b*, these vessels are connected to the developing spaces 12*a* and 12*b* in the developing tanks 17*a* and 17*b*, tanks 17*a* and 17*b* can be filled with developer up to riser pipes 21*a* and 21*b*. After development, the developing spaces are emptied by lowering the vessels 19*a* and 19*b*. The contacts 18*a* and 18*b* are then disconnected from each other or from the voltage source 8, the tank halves 17*a* and 17*b* are separated from each other, and the developed foil 1, is removed.

What is claimed is:

1. An electrophotographic process comprising the steps of:

providing a highly electrically insulating foil, said foil having first and second opposite sides;

generating identical electrostatic charge images of a radiation image on the first and second opposite sides of the foil, respectively, the charge image on the first side having an opposite sign as compared to the charge image on the second side; and depositing pigment on each side of the foil, said pigment comprising a developer having a charge whose sign is opposite to that of the electrostatic charge image on the side of the foil on which the pigment is being deposited;

CHARACTERIZED IN THAT:

the electrostatic charge image is generated on the first side of the foil by generating charge pairs, all charges of one sign from each pair being collected on the first side of the foil, said charge pairs being generated by a reaction between radiation-sensitive material and incident radiation;

the electrostatic charge image is generated on the second side of the foil by a charge exchange between the second side of the foil and an electrode adjacent thereto, said charge exchange effectively collecting all of the remaining generated charges, of opposite sign from the charges on the first side, on the second side of the foil; and further comprising the step of separating the electrode from the foil prior to depositing the pigment.

2. A process as claimed in claim 1, CHARACTERIZED IN THAT during the charge exchange the electrode is attached to the second side of the foil.

3. A process as claimed in claim 1, CHARACTERIZED IN THAT the electrode comprises a corona discharge.

4. A process as claimed in claim 2 or 3, CHARACTERIZED IN THAT the foil is transparent to the radiation image.

5. A process as claimed in claim 4, CHARACTERIZED IN THAT the charge pairs are generated by irradiating an ionizable gas.

* * * * *